US011020847B2

(12) United States Patent
Lai et al.

(10) Patent No.: US 11,020,847 B2
(45) Date of Patent: Jun. 1, 2021

(54) BITS RECEIVED INSIDE OF A HANDLE OF SCREWDRIVER

(71) Applicants: Chia Wei Lai, Taichung (TW); Min Hung Lai, Taichung (TW)

(72) Inventors: Chia Wei Lai, Taichung (TW); Min Hung Lai, Taichung (TW)

( * ) Notice: Subject to any disclaimer, the term of this patent is extended or adjusted under 35 U.S.C. 154(b) by 194 days.

(21) Appl. No.: 14/462,578

(22) Filed: Aug. 19, 2014

(65) Prior Publication Data

US 2016/0052124 A1 Feb. 25, 2016

(51) Int. Cl.
*B25G 1/08* (2006.01)
*B25B 15/02* (2006.01)

(52) U.S. Cl.
CPC ..... *B25G 1/085* (2013.01); *B25B 15/02* (2013.01)

(58) Field of Classification Search
CPC ..... B25G 1/085; B25B 15/02
USPC ..... 81/438, 177.4
See application file for complete search history.

(56) References Cited

U.S. PATENT DOCUMENTS

| | | | | |
|---|---|---|---|---|
| 19,901 | A * | 4/1858 | Aiken | B25G 1/085 81/490 |
| 273,621 | A * | 3/1883 | Small | B25G 1/085 206/375 |
| 8,561,507 | B2 * | 10/2013 | Huang | B25B 15/02 81/177.4 |
| 8,590,432 | B2 * | 11/2013 | Wang | B25G 1/085 81/177.4 |
| 8,833,214 | B2 * | 9/2014 | Wang | B25G 1/085 81/177.4 |
| 9,174,334 | B2 * | 11/2015 | Chen | B25G 1/085 |

* cited by examiner

*Primary Examiner* — Hadi Shakeri
(74) *Attorney, Agent, or Firm* — Che-Yang Chen; Law Offices of Scott Warmuth

(57) ABSTRACT

A screwdriver includes a shank with a handle connected to a collar rotatably and a base is located in a room of the handle. At least one resilient extending from the underside of the collar is inserted in at least one recess of the handle. The base connected to the outside of the collar has a rod connected to a positioning member. The positioning member is defined with multiple slots able to hold bits in position in the room. One side of the base is sealed by a cap. Therefore, the bits are received inside of the handle so as to carry with the screwdriver.

5 Claims, 11 Drawing Sheets

BITS RECEIVED INSIDE OF A HANDLE OF SCREWDRIVER

BACKGROUND OF THE INVENTION

1. Fields of the Invention

The present invention relates to a handle of a screw driver, and more particularly, to a handle of a screwdriver that is able to sore plural bits inside of.

2. Descriptions of Related Art

The conventional screwdrivers are used to tighten or loosen objects such as bolts and nuts, and comprise a handle and a shank in a piece. Bit on the top of the shank can be defined in shapes such as flat, cross or hexagonal corresponding to the head shape of the screws. The users have to prepare and carry many screwdrivers with different bits.

A screwdriver known to applicant discloses a handle, a securing member, an adjustment member, and a bit, wherein the handle has an axial hole defined therein and the securing member is connected to one end of the axial hole so as to restrict the adjustment member. The securing member has positioning holes and the bits are inserted into the positioning holes. The securing member has at least one groove in the inside of the positioning hole so as to position the bit in the positioning hole. By rotating the adjustment member, a block is removed and the bit is accessed so that the user can pick the desired bit to use. However, the size of the handle has to be large enough to accommodate the bits, and the tool box is therefore large enough to carry the screwdrivers with the above-mentioned handles.

The present invention intends to provide a screwdriver handle that is able to accommodate multiple bits while the shortcomings mentioned above are eliminated.

SUMMARY OF THE INVENTION

The present invention relates to a screwdriver and comprises a shank having a connector on one end and a handle on the other end of the shank. The connector is able to be connected on the narrow neck on one end of a bit and the other end of the bit is working end. A tubular portion is defined on the end of the handle and a ridge extends from the outside of the tubular portion. The ridge has at least one cut. The handle has a recess corresponding to location of the cut and communicating with the cut. An engaging flange extends from the distal end of the tubular portion. The handle has a polygonal room defined therein.

A collar is secured to the end of the handle and comprises a through hole. The collar has at least one resilient member extending from the underside thereof. The at least one resilient member is inserted in the recess of the handle. A stop extends from the underside of the collar and located beside the at least one resilient member. The stop is located in the cut of the ridge of the handle. At least one notch and at least one first block are formed on the top end of the collar. An annular groove extends from the inside of the collar, and the engaging flange on the handle is engaged with the annular groove.

A base is connected to the top of the collar and has a polygonal reception member extending from the underside thereof. The reception member is located in the room of the handle and has a tube extending therefrom. The tube has a stepped hole defined axially therein. At least one protrusion extends from the outside of the reception member and extends through the notch of the collar. A rod having a lip extending radially from the first end thereof, and the lip is secured in the stepped hole of the tube of the base. An insertion end is formed on the second end of the rod and extends beyond the tube. A stop flange extends radially outward from the second end of the rod and is located beside the insertion end. A positioning member is connected to the insertion end and has a hole with which the insertion end is engaged. The positioning member has multiple slots so as to hold bits therein. A cap is used to seal the end of the base.

Preferably, the collar has an anti-slip face defined in the outside thereof.

Preferably, the at least one first block has a vertical face formed on the first side thereof, and an inclined face is formed on the second side of the at least one first block. The base has multiple second blocks extending from the inside thereof. Each of the second blocks has a vertical face formed on the first side thereof. An inclined face is formed on the second side of each of the second blocks. The at least one first block of the collar contacts one of the second blocks.

Preferably, the base has at least one annular flange extending from the outside thereof. The cap has at least one annular groove defined in the inside thereof. The at least one annular flange is engaged with the at least one annular groove.

Preferably, the bit has a tip and an insertion end respectively formed on two ends thereof. The reception member of the base accommodates the tip of the bit, and the insertion end of the bit has a neck defined in the outside thereof. The neck is engaged with one of the slots of the positioning member.

The primary object of the present invention is to provide a screwdriver with a handle able to store at least one bit inside so as to be easily carried.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
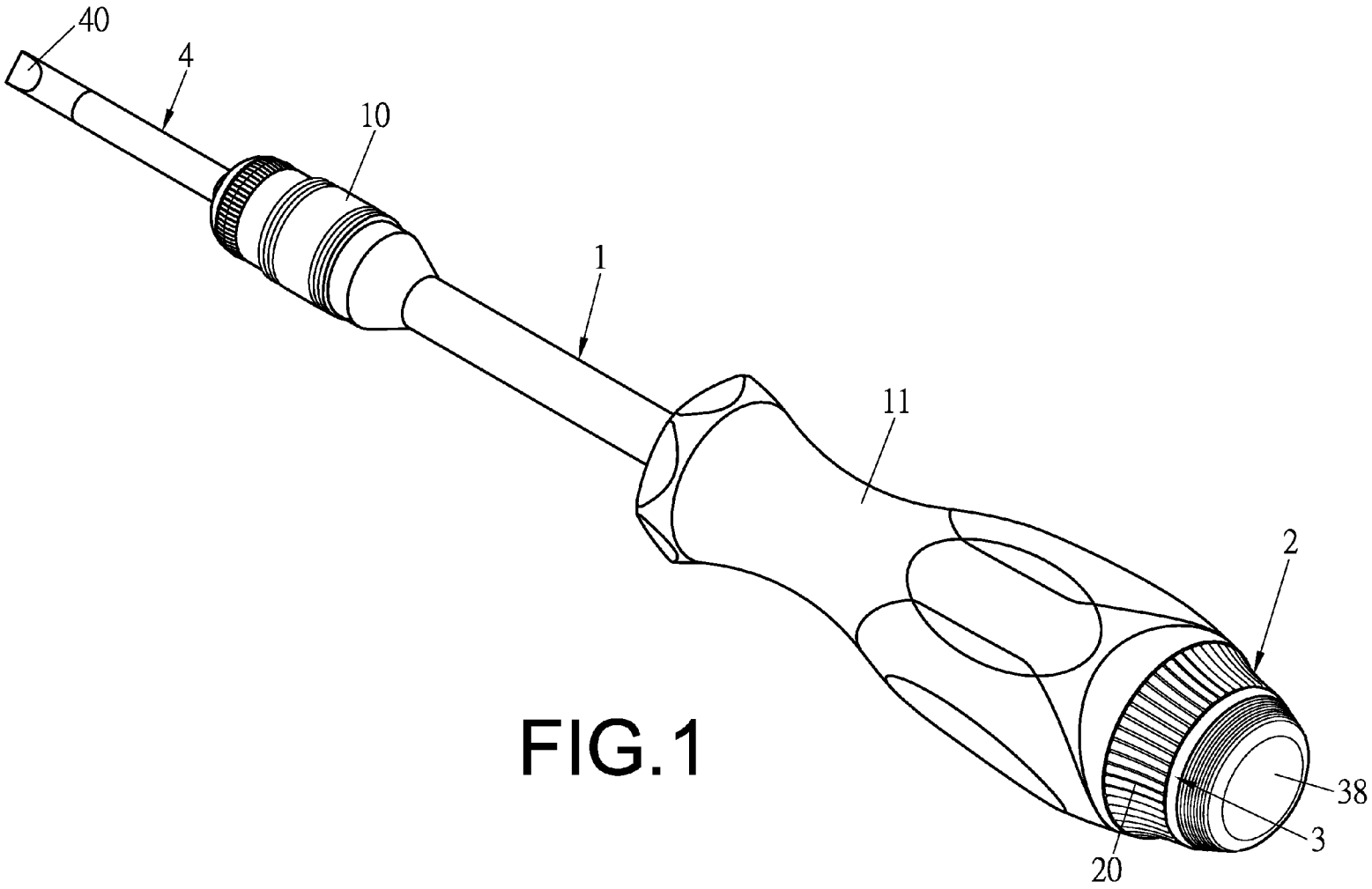
FIG. 1 is a perspective view to show the screwdriver of the present invention.
Figure 2:
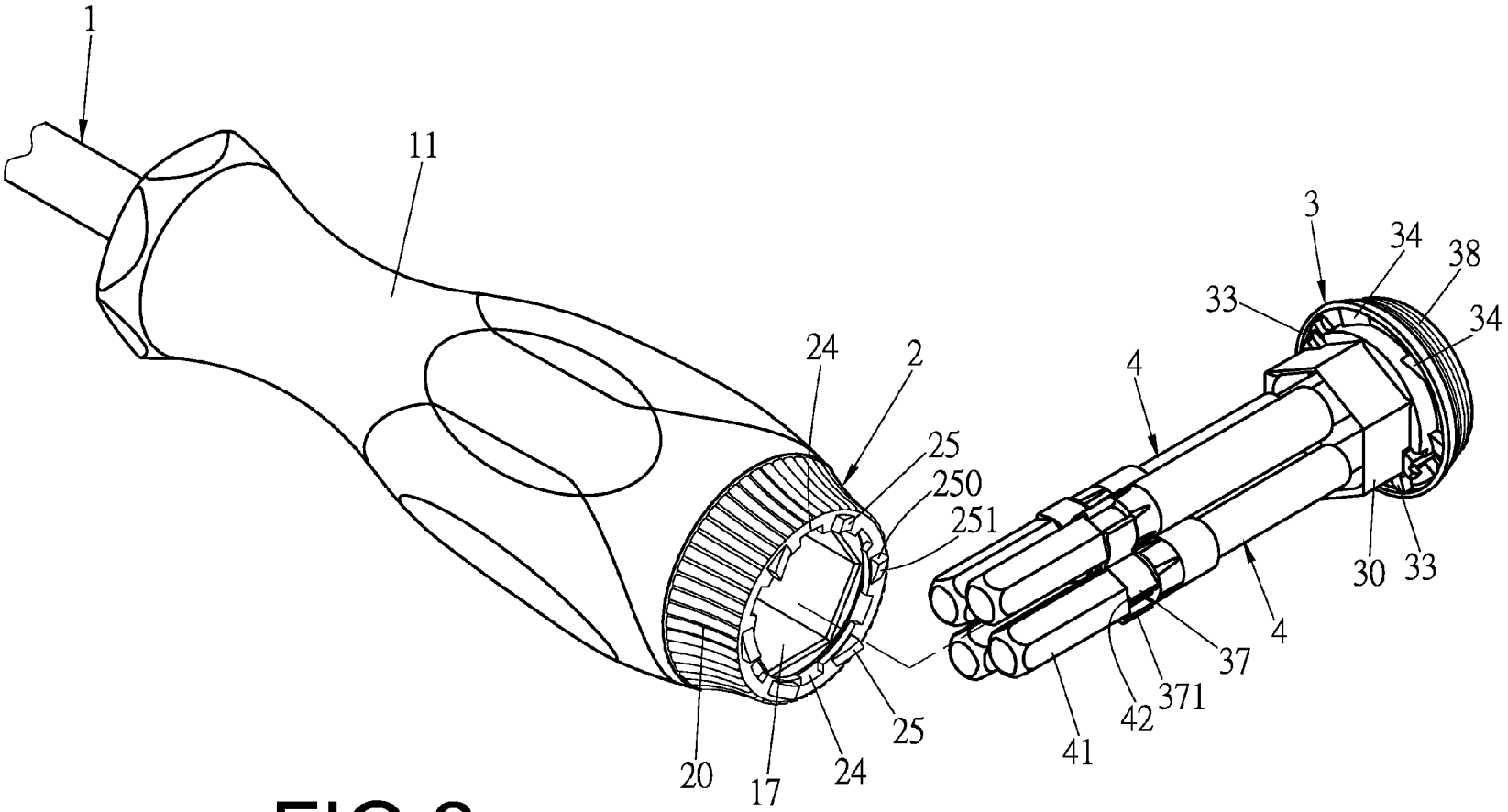
FIG. 2 shows that the bits together with the base are removed from the handle of the screwdriver of the present invention.
Figure 3:
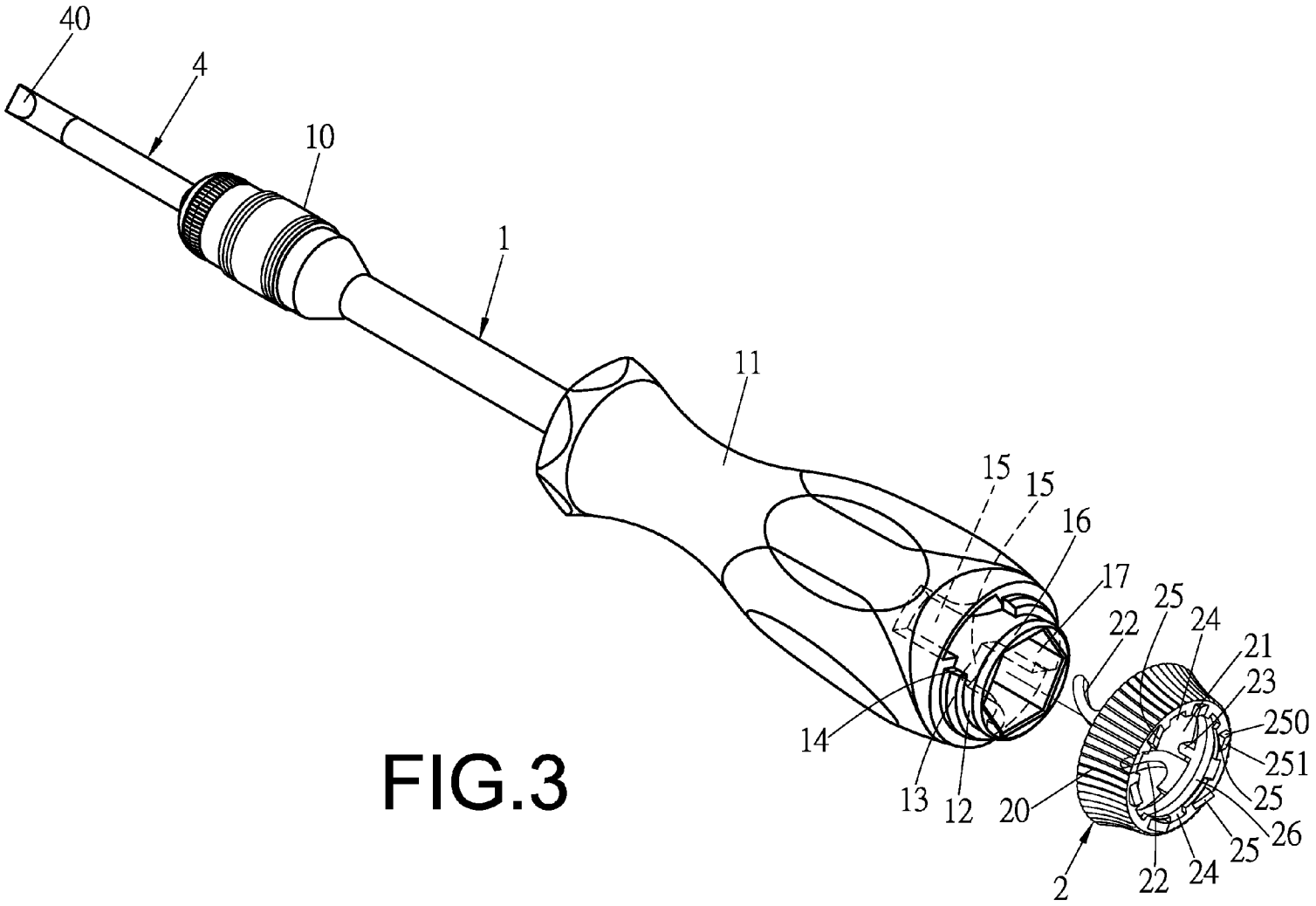
FIG. 3 is an exploded view of the collar and the screwdriver of the present invention.
Figure 4:
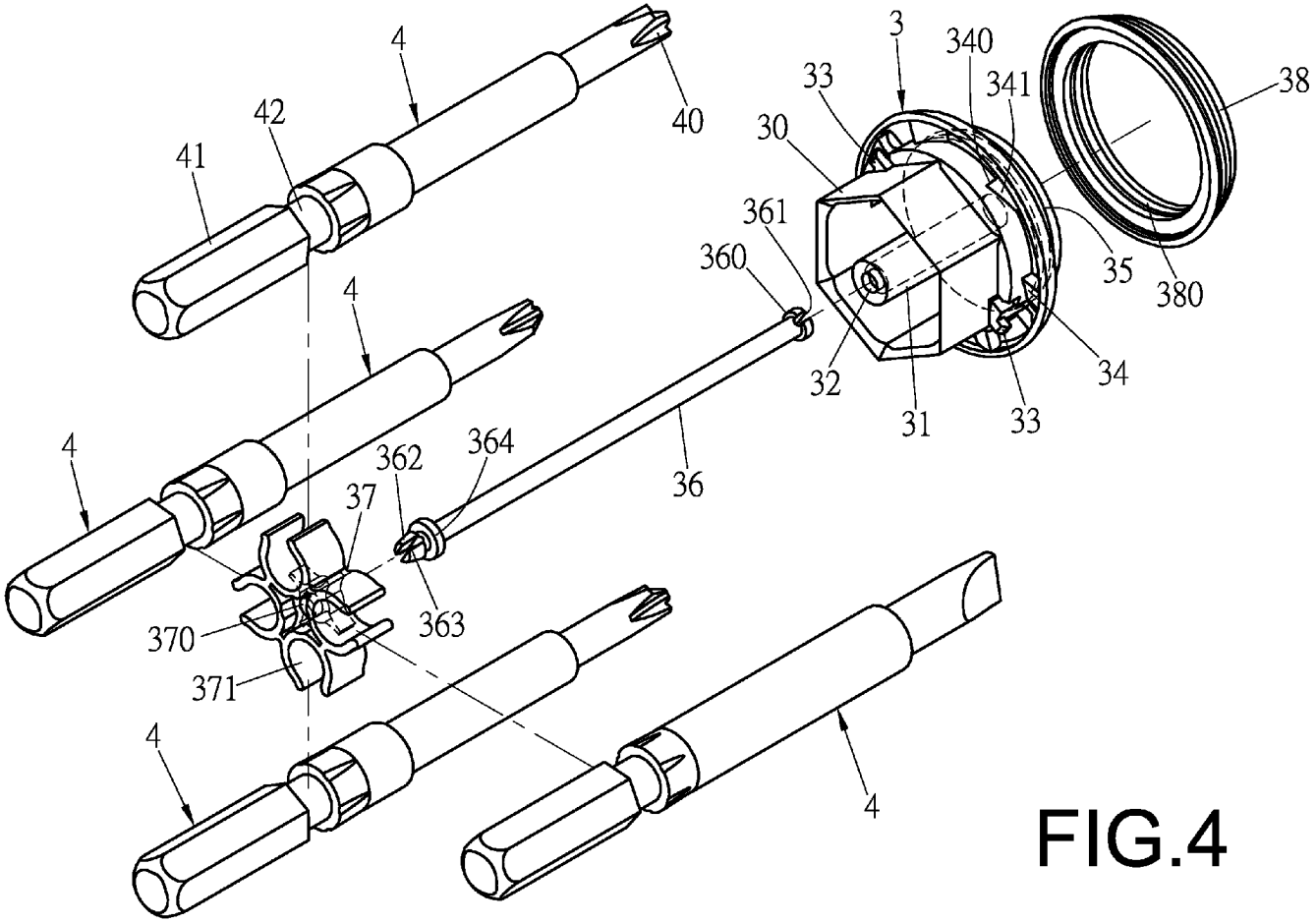
FIG. 4 is an exploded view of the bits and the base of the screwdriver of the present invention.
Figure 5:
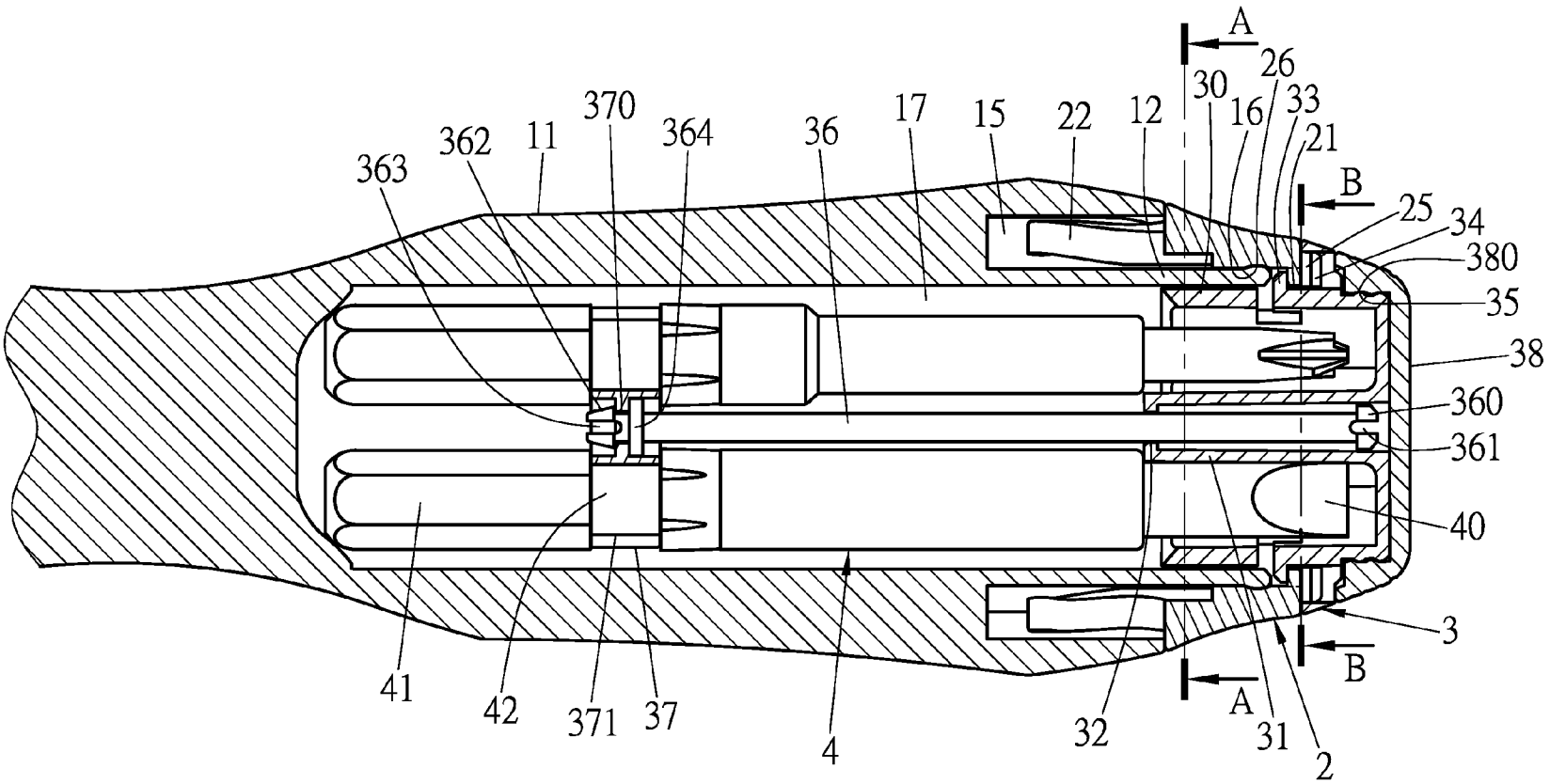
FIG. 5 is a cross sectional view of the handle with the base, the collar and the bits connected thereto.

Referring to FIGS. 1 to 6, the screwdriver of the present invention comprises a shank 1 having a connector 10 able to be connected with a bit 4 or other part at first end of the shank 1 and a handle 11 is defined on the second end of the shank 1. A tubular portion 12 extends outwardly from the handle 11 and a ridge 13 is defined on the tubular portion 12, wherein the ridge 13 has two cuts 14. Two recesses 15 are defined on the end of the handle 11 and respectively located corresponding to the two cuts 14 and communicate with the cut 14. An engaging flange 16 extends longitudinally from the distal end of the tubular portion 12. The handle 11 has a polygonal room 17 defined therein.

A collar 2 is rotatably secured to the end of the handle 11 of the shank 1 and has a through hole 21 in the middle of the collar 2. Two resilient members 22 extend from the underside of the collar 2 and are respectively inserted in the two recesses 15 of the handle 11. Two respective stops 23 extend from the underside of the collar 2 and each are located beside the resilient member 22 corresponding thereto. The stops 23 are respectively located in the two cuts 14 of the ridge 13 of the handle 11. Multiple notches 24 and multiple first blocks 25 are formed on the top end of the collar 2. Each of the first blocks 25 has a vertical face 250 formed on the first side thereof. An inclined face 251 is formed on the second side of each of the first blocks 25. An annular groove 26 extends from the inside of the collar 2. The engaging flange 16 on the handle 11 is engaged with the annular groove 26. The collar 2 has an anti-slip face 20 defined in the outside thereof.

A base 3 is connected to the top of the collar 2 and a polygonal reception member 30 extends from the underside of the base 3. The reception member 30 is located in the room 17 of the handle 11 and has a tube 31 extending therefrom. The tube 31 has a stepped hole 32 defined axially therein. Two protrusions 33 extend from the outside of the reception member 30 and extend through the notches 24 of the collar 2. The base 3 further has multiple second blocks 34 extending from the inside thereof. Each of the second blocks 34 has a vertical face 340 formed on the first side thereof, and an inclined face 341 is formed on the second side of each of the second blocks 25. The base 3 has at least one annular flange 35 extending from the outside thereof.

One end of a rod 36 is secured in the stepped hole 32 of the tube 31 of the base 3 and the other end of the rod 36 extends from the tube 31 of the base 3, wherein a lip 360 defined on one end of the rod 36 with a slot 361 and a conical insertion end 362 formed on the other end of the rod 36. A gap 363 is defined in the insertion end 362 so as to form two tapered parts on the insertion end 362. A stop flange 364 is defined at rear end of the insertion end 362.

A positioning member 37 is connected to the insertion end 362 and has a hole 370 with which the insertion end 362 is engaged. The positioning member 37 has multiple slots 371. A cap 38 is used to seal the end of the base 3. The cap 38 has at least one annular groove 380 defined in the inside thereof. The at least one annular flange 35 is engaged with the at least one annular groove 380.

Multiple bits 4 each have a tip 40 and an insertion end 41 separately formed on two ends of each of the bits 4. The reception member 30 of the base 3 accommodates the tip 41 of the bits 4. The insertion end 41 of each of the bits 4 has a narrow neck 42 defined in the outside thereof. The neck 42 is engaged with one of the slots 371 of the positioning member 37. The bits 4 can be optionally connected to the connector 10 on the shank 1.

Figure 6:
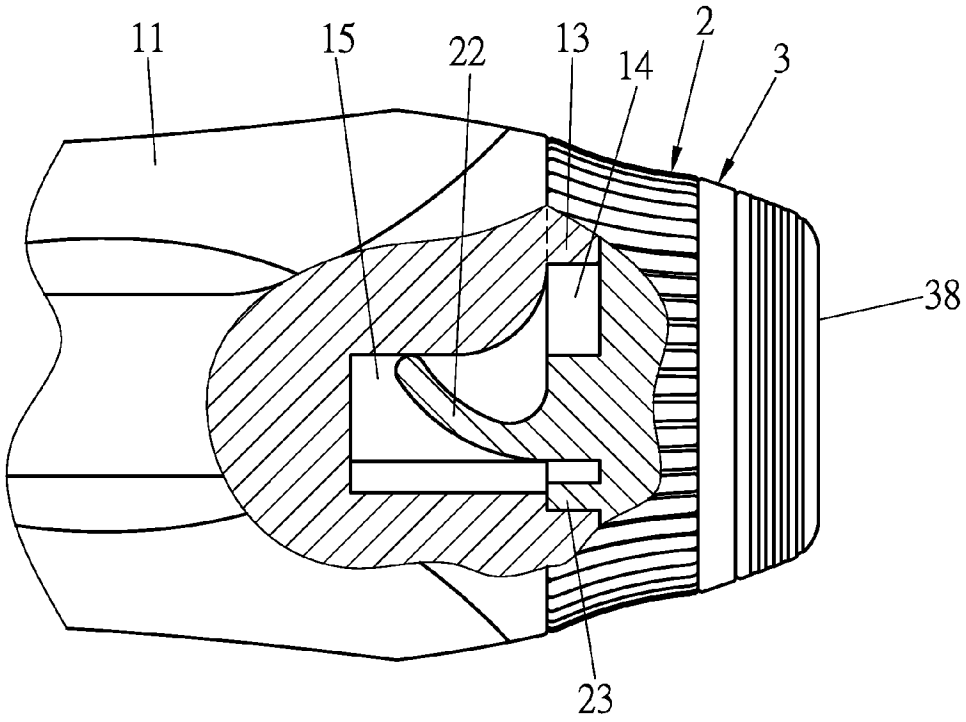
FIG. 6 shows that the resilient member of the collar is located in the recess of the handle of the screwdriver of the present invention.
Figure 7:
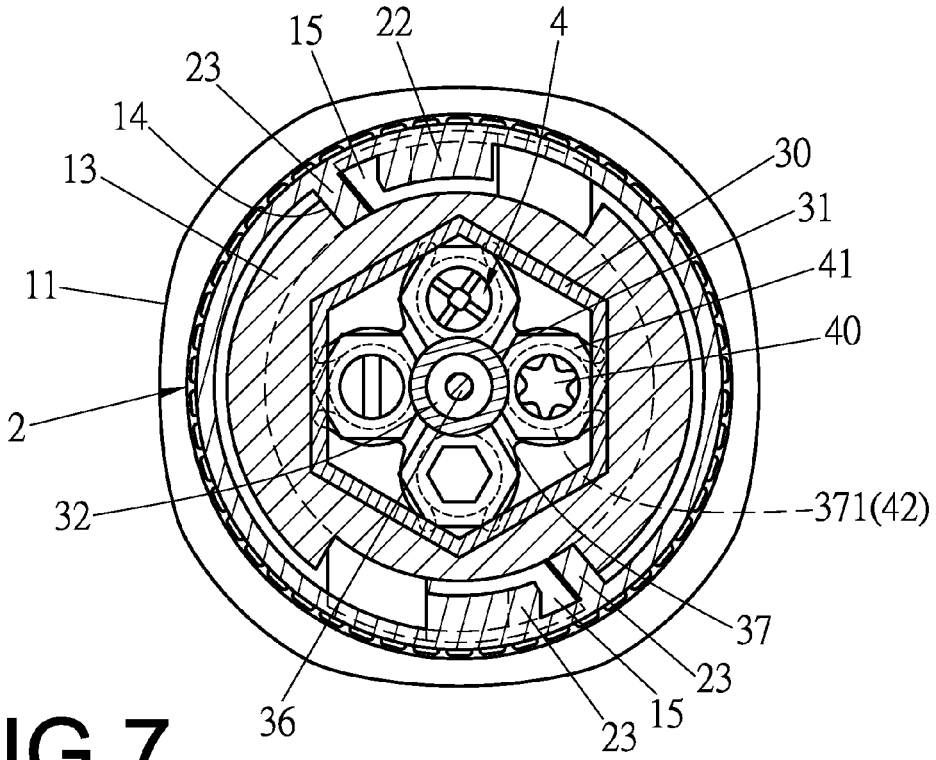
FIG. 7 is a cross sectional view, taken along line A-A of FIG. 5.
Figure 8:
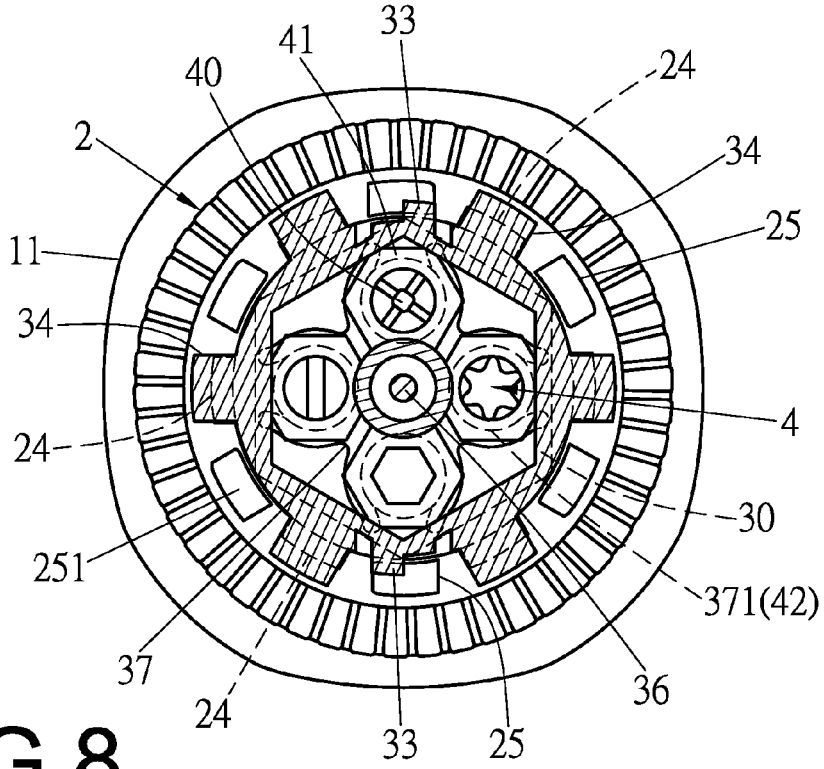
FIG. 8 is a cross sectional view, taken along line B-B of FIG. 5.
Figure 9:
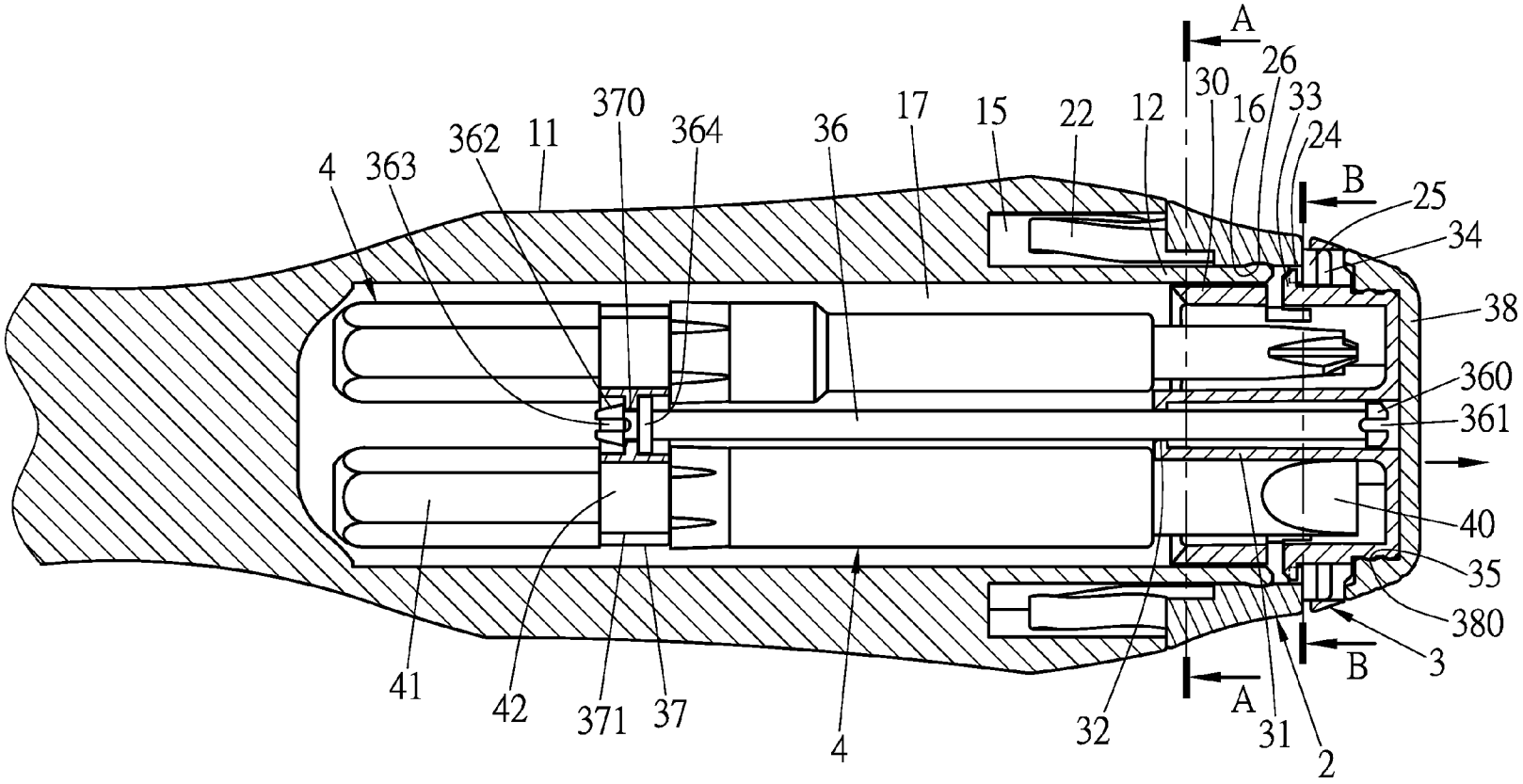
FIG. 9 is a cross sectional view to show that the collar is located at the released position.
Figure 10:
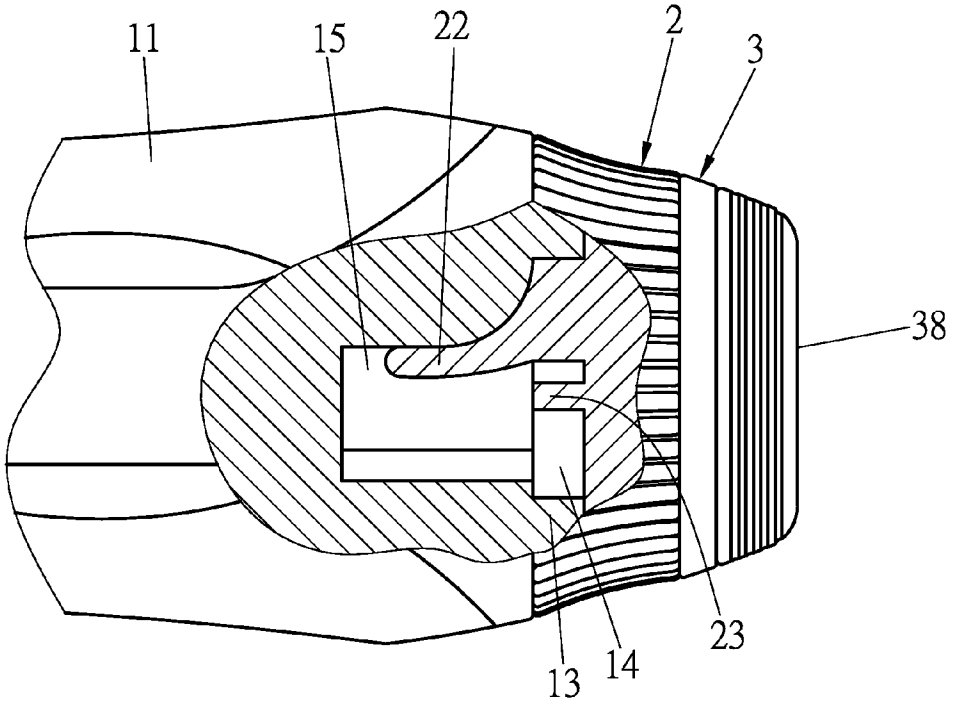
FIG. 10 shows that the resilient member of the collar located in the recess of the handle of the screwdriver of the present invention is compressed.
Figure 11:
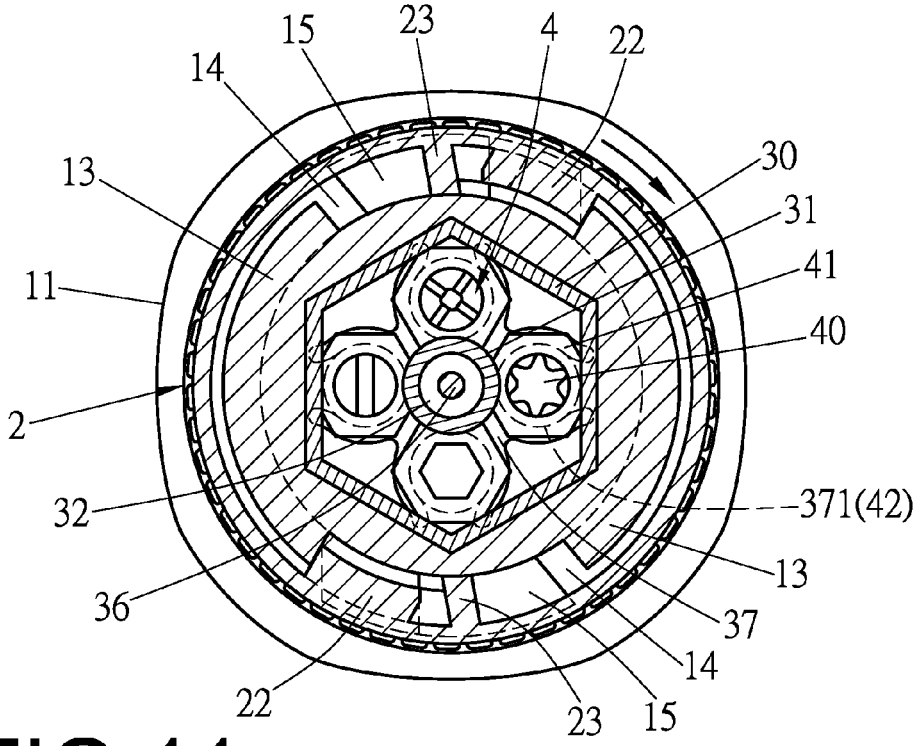
FIG. 11 is a cross sectional view, taken along line C-C of FIG. 9.
Figure 12:
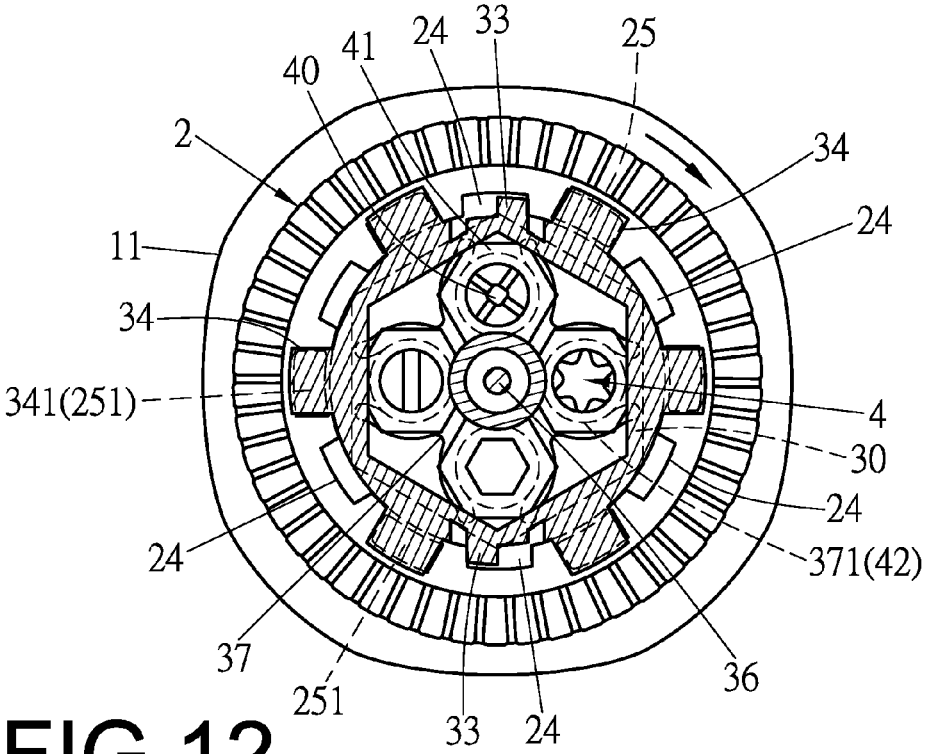
FIG. 12 is a cross sectional view, taken along line D-D of FIG. 9.

When in assembling, as shown in FIGS. 1 to 12, the two resilient members 22 of the collar 2 are inserted into the recesses 15 of the handle 11 as shown in FIG. 6, and each of the stops 23 located beside the resilient member 22 is located in the cut 14 as shown in FIG. 7. The engaging flange 16 on the handle 11 is engaged with the annular groove 26 of the collar 2 to rotatably connect the collar 2 to the handle 11. The first end with the lip 360 of the rod 36 is inserted into the stepped hole 32 of the base 3, because of the slot 361 so that the lip 360 is narrowed and passes through the stepped hole 32 of the base 3. The second end of the rod 36 extends beyond the tube 31. The cap 38 is used to be sealed outside of the base 3. The at least one annular flange 35 is engaged with the at least one annular groove 380. The cap 38 prevents the rod 36 from extending through the base 3. The positioning member 37 is connected to the rod 36 beyond the tube 31 and the insertion end 362 of the rod 36 extends through the hole 370 of the positioning member 37 so that the positioning member 37 is located between the insertion end 362 and the stop flange 364. The bits 4 are then positioned by the slots 371 of the positioning member 37 by engaging the necks 42 with the slots 371. The combination of the base 3 and the bits 4 is inserted into the room handle 11, wherein the bits 4 and the rod 36 are located in the room 17 of the handle 11. The tips 40 of the bits 4 are inserted in the reception member 30 which is also located in the room 17. The collar 2 is slightly rotated, the two resilient members 22 of the collar 2 are compressed as shown in FIGS. 10 and 11, so that the notches 24 of the collar 2 are located corresponding to the protrusions 33 of the base 3 as shown in FIG. 12. The protrusions 33 of the base 3 are inserted into the notches 24 and the collar 2 is released, the resilient members 22 pivot the collar 2 to its initial position as shown in FIG. 6. The protrusions 33 on the base 3 are disengaged from the notches 24 of the collar 2 as shown in FIG. 8, the base 3 is engaged with the collar 2 to complete the assembly.

Figure 13:
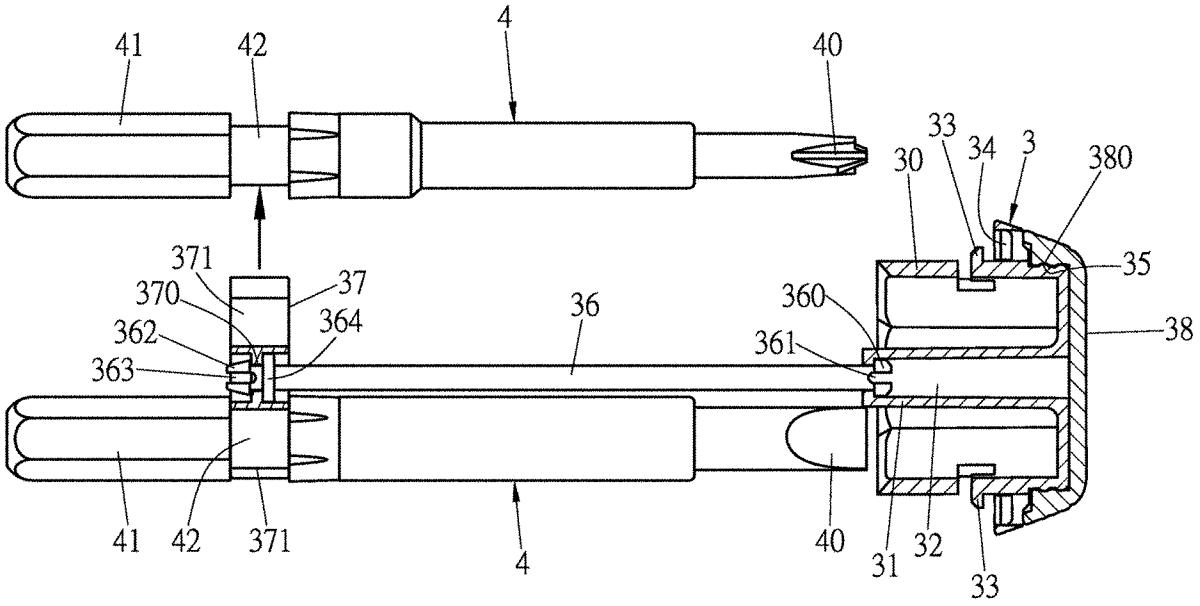
FIG. 13 shows that one of the bits is removed from the positioning member of the base.

When picking one of the bits 4 from the handle 11, as shown in FIGS. 5 to 13, the collar 2 is rotated as shown in FIGS. 9 to 13, the two resilient members 22 of the collar 2 are compressed as shown in FIGS. 10 and 11, and the notches 24 of the collar 2 are located corresponding to the protrusions 33 of the base 3 as shown in FIG. 12. The inclined face 251 of each first block 25 contacts the inclined face 341 of each second block 34, the first blocks 25 on the collar 2 push the second blocks 34 on the base 3 to move the base 3 outward as shown in FIG. 9. The base 3 is no longer secured to the collar 2, the protrusions 33 of the base 3 are removed from the notches 24 and the collar 2. The protrusions 33 of the base 3 are not connected to the collar 2, the base 3 then can be removed from the handle 11. The bits 4 and the rod 36 are moved as shown in FIG. 13, the tip 40 of the desired bit 4 can be removed from the reception member 30, and the bit 4 can be picked from the positioning member 37. The bit 4 that is removed from the connector 10 can be positioned by the slot 371 of the positioning member 37. The rod 36 and the bits 4 are again inserted into the room 17 of the handle 11, and the tips 40 of the bits 4 are located in the reception member 30. The collar 2 is rotated again as shown in FIG. 11 to compress the two resilient members 22 as shown in FIG. 10 and to align the notches 24 with the protrusions 33 as shown in FIG. 12. The protrusions 33 are then engaged with the notches 24. Then the collar 2 is released, the resilient members 22 pivot the collar 2 to its initial position as shown in FIGS. 6, 7. The protrusions 33 on the base 3 are disengaged from the notches 24 of the collar 2 as shown in FIG. 8, the base 3 is engaged with the collar 2.

The present invention provides a compact handle 11 that is able to accommodate multiple bits 4 and the bits 4 can be easily replaced and stored.

While we have shown and described the embodiment in accordance with the present invention, it should be clear to those skilled in the art that further embodiments may be made without departing from the scope of the present invention.

What is claimed is:

1. A screwdriver comprising:

a shank having a connector connected to one end a handle connected to the other end, wherein, a tubular portion extending from the other end of the handle and a ridge extending from an outside of the tubular portion, the ridge having at least one cut, the handle having a recess which is located corresponding to the cut and communicates with the cut, an engaging flange extending from a distal end of the tubular portion, the handle having a polygonal room defined therein;

a collar mounted to the other end of the handle and having a through hole, the collar having at least one resilient member extending from an underside thereof, the at least one resilient member inserted in the recess of the handle, a stop extending from the underside of the collar and located beside the at least one resilient member, the stop located in the cut of the ridge of the handle, at least one notch and at least one first block formed on a top end of the collar, an annular groove extending from an inside of the collar, the engaging flange on the handle engaged with the annular groove, and a base connected to the top end of the collar and having a polygonal reception member extending from an underside thereof, the reception member located in the room of the handle and having a tube extending therefrom, the tube having a stepped hole defined axially therein, at least one protrusion extending from an outside of the reception member and extending through the notch of the collar, a rod having a lip extending radially from a first end thereof, the lip being secured in the stepped hole of the tube of the base, an insertion end formed on a second end of the rod and extending beyond the tube, a stop flange extending radially outward from the second end of the rod and located beside the insertion end, a positioning member connected to the insertion end and having a hole with which the insertion end is engaged, the positioning member having multiple slots, a cap sealed the end of the base.

2. The screwdriver as claimed in claim 1, wherein the collar has an anti-slip face defined in an outside thereof.

3. The screwdriver as claimed in claim 1, wherein the at least one first block has a vertical face formed on a first side thereof, an inclined face is formed on a second side of the at least one first block, the base has multiple second blocks extending from an inside thereof, each of the second blocks has a vertical face formed on a first side thereof, an inclined face is formed on a second side of each of the second blocks, the at least one first block of the collar contacts one of the second blocks.

4. The screwdriver as claimed in claim 1, wherein the base has at least one annular flange extending from an outside thereof, the cap has at least one annular groove defined in an inside thereof, the at least one annular flange is engaged with the at least one annular groove.

5. The screwdriver as claimed in claim 1, wherein a bit has a tip and an insertion end respectively formed on two ends thereof, the reception member of the base accommodates the tip of the bit, the insertion end of the bit has a neck defined in an outside thereof, and the neck is engaged with one of the slots of the positioning member.

* * * * *